United States Patent [19]

Deal

[11] Patent Number: 4,631,844

[45] Date of Patent: Dec. 30, 1986

[54] HYDRAULIC SHOVEL DREDGE SYSTEM

[76] Inventor: Troy M. Deal, 277 Trismen Ter., Winter Park, Fla. 32789

[21] Appl. No.: 754,992

[22] Filed: Jul. 15, 1985

[51] Int. Cl.[4] ..... E02F 3/92

[52] U.S. Cl. ..... 37/58; 37/57; 37/71

[58] Field of Search ..... 37/71, 57, 58

[56] References Cited

U.S. PATENT DOCUMENTS

| | | | |
|---|---|---|---|
| 413,091 | 10/1889 | Riker | 37/71 X |
| 2,144,743 | 1/1939 | Schulz | 37/57 X |
| 2,178,265 | 10/1939 | Peterson | 37/57 |
| 2,952,083 | 9/1960 | Forkner | 37/71 |
| 3,495,409 | 2/1970 | Riedemann | 37/58 X |
| 3,774,323 | 11/1973 | Vaughn | 37/71 X |

FOREIGN PATENT DOCUMENTS

| | | | |
|---|---|---|---|
| 189133 | 2/1957 | Austria | 37/71 |
| 1236573 | 6/1960 | France | 37/71 |
| 7701070 | 8/1978 | Netherlands | 37/71 |

*Primary Examiner*—Clifford D. Crowder
*Attorney, Agent, or Firm*—Beaman & Beaman

[57] ABSTRACT

An underwater dredging system using a power-driven shovel. The shovel is manipulated to accumulate dredged solid material in the shovel bucket and the bucket is in communication with a pump suction conduit continuously removing the dredged material from the bucket. Screens and guards prevent oversized particles from entering the suction conduit, and predetermined relationships and configurations of the bucket and the suction conduit accommodate the movements of the pivotally mounted bucket.

6 Claims, 5 Drawing Figures

HYDRAULIC SHOVEL DREDGE SYSTEM

BACKGROUND OF THE INVENTION

The dredging of the bottoms of bodies of water usually takes one of two forms, suction dredging or shovel dredging. Each system has its own advantages and limitations as discussed below.

In underwater suction dredging operations the apparatus consists of a vessel or barge floating upon the water surface and the inlet of a pump suction system is positioned below the barge permitting the pumping, and removal, of a slurry formed by the bottom materials and water. Cutterhead apparatus is normally associated with the suction conduit inlet having cutter and agitating elements, often power-driven, for loosening the bottom material and conveying the loosened material toward the suction conduit and large volumes of material can be continuously handled.

While a wide variety of suction dredge cutterheads have been proposed and used with suction dredges, cutterheads using continuously rotating augers, knives, tools and the like are most advantageously utilized where the bottom material is relatively soft and free of large rocks, stumps and similar hard foreign objects. Also, cutterheads of the rotating cutter type, or which use hydraulic jets to loosen the bottom material, are relatively ineffective in handling heavy consolidated bottom soil and material, and such cutterheads are easily damaged in such environments.

In shovel dredging systems buckets are used and the bucket is manipulated away from or toward the operator to "scoop" the bottom material into the bucket and the bucket supporting apparatus is operated to raise the loaded bucket above the water level and deposit the dredged material ashore, or in an adjacent barge or other container capable of receiving the material from the bucket.

While the use of shovel bucket dredges permits the dredging of water bottoms having heavy consolidated material, large rocks, stumps and the like, such operations are slow, expensive and inefficient, in that the bucket must be raised, swung and moved substantial distances and unloaded, and movement of the bucket upwardly through the water will wash much of the material from the bucket prior to unloading.

Where the dredge is being used to mine the water bottom material, such as in gold mining operations, the tendency for the dredge material to "wash" from the shovel bucket as it is moved upwardly through the water is particularly troublesome in that valuable material may be lost, and only a portion of the material originally contained in the bucket is retained for processing.

It is an object of the invention to provide a shovel dredging system utilizing a suction pump for handling the dredged material wherein the advantages of suction and shovel dredging systems are combined and the disadvantages are eliminated.

Another object of the invention is to provide a shovel dredging system wherein the bottom material is accumulated within the shovel bucket and is continuously removed from the shovel bucket by the suction conduit of a suction pump system.

Yet another object of the invention is to provide a shovel dredge system using a dredging bucket and a pump suction line to directly remove the dredged material from the bucket to minimize the manipulation of the shovel during operation.

An additional object of the invention is to provide a shovel dredging system wherein the dredged material is directly removed from the shovel bucket by the suction conduit of a pump system and guards and screens are used with the shovel and suction conduit to prevent the entrance of oversize particles into the conduit.

A further object of the invention is to provide a shovel dredge system wherein a pivotal shovel bucket is in communication with the suction conduit of a pump system, and the configuration of the suction conduit and bucket include segments concentric with the bucket pivot axis to prevent interference during bucket movement.

In the practice of the invention a power-operated shovel apparatus is mounted upon a floating barge. The barge may include vertically extendable jacks and stabilizers for engaging the bottom material of the body of water being dredged to improve stability. In the disclosed embodiment processing apparatus is mounted upon the barge for sorting and separating the dredged material for gold mining purposes, and while the inventive concepts are advantageously utilized in the mining of submerged material, the apparatus may, likewise, be advantageously employed for conventional dredging operations wherein the purpose is to remove bottom material and spoils from the waterway to increase the depth, form channels, etc. In the disclosed embodiment the shovel apparatus is of the hydraulic type consisting of a plurality of pivotally interconnected linkages or arms whose relative relationships may be adjusted by hydraulic expansible chamber motors. The disclosed shovel apparatus is similar to that commonly known as a "backhoe" and the shovel apparatus is pivotally mounted upon the barge and controlled by valves conveniently located for manipulation by the operator. The free end of the shovel system includes a bucket which is mounted upon the arms and is capable of limited pivotal movement by a hydraulic motor.

A powerful motor-driven pump is mounted upon the barge having an outlet conduit communicating with the processing apparatus, and the pump includes a suction conduit having an inlet end mounted upon the shovel apparatus above the shovel bucket. An evacuation conduit is attached to the shovel apparatus adjacent the bucket and includes an upper end connected to the pump suction conduit, and the lower end constitutes an inlet which is located within the shovel bucket.

Accordingly, as the evacuation conduit inlet is located within the bucket the pump will be supplied with water and dredged material directly from the bucket and keep the bucket relatively "empty" of dredged bottom material.

A grid or screen is usually located over the open end of the bucket to prevent oversize particles from entering the bucket and during dredging the bucket is moved through short forward strokes sufficient to fill the bucket with material, but preventing the bucket from being raised from the water so that air will not enter the bucket and pump system. The evacuation conduit will be continuously removing the water and dredged material from the bucket and a high efficiency of bucket operation is achieved in that time consuming movements of the bucket are eliminated.

The shovel bucket includes a bottom wall which is of a concave cylindrical configuration having a center coincident with the bucket pivot axis, and the evacuation conduit is provided with a bell shield having a peripheral edge located in a predetermined spaced relationship to the bucket bottom wall. This spacing prevents oversize particles from entering the evacuation conduit, and the concentric relationship of the bucket bottom wall to the bucket pivot will maintain this spacing during bucket pivotal movement.

The bucket also includes a rear wall having an opening defined therein, and the evacuation conduit enters the bucket through this opening. The evacuation conduit includes an elbow arcuate portion located within the bucket opening which is of a configuration concentric to the bucket pivot axis, and this relationship prevents interference between the evacuation conduit elbow and bucket during bucket pivotal movement.

The continuous removal of dredged material and water from the bucket through the evacuation conduit will provide a consistent supply of slurried material to the processing apparatus mounted on the barge. While the manipulation of the shovel apparatus will load the bucket somewhat intermittently the pump suction system will continually remove the dredged material from the bucket and the operator may engage in a substantially "continuous" dredging and digging operation by the shovel apparatus. As the dredged material is removed from the shovel bucket adjacent the bottom wall, heavy material, such as gold, will be drawn into the pump system for processing, and very little material entering the bucket is "lost" due to bucket movement through the water.

The shovel is capable of readily dredging hard consolidated materials and large rocks and stumps will not damage the apparatus. If desired, underwater television apparatus may be attached to the shovel apparatus to permit observation in the area being dredged, and the practice of the invention substantially improves the efficiency of a dredging operation utilizing a shovel.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
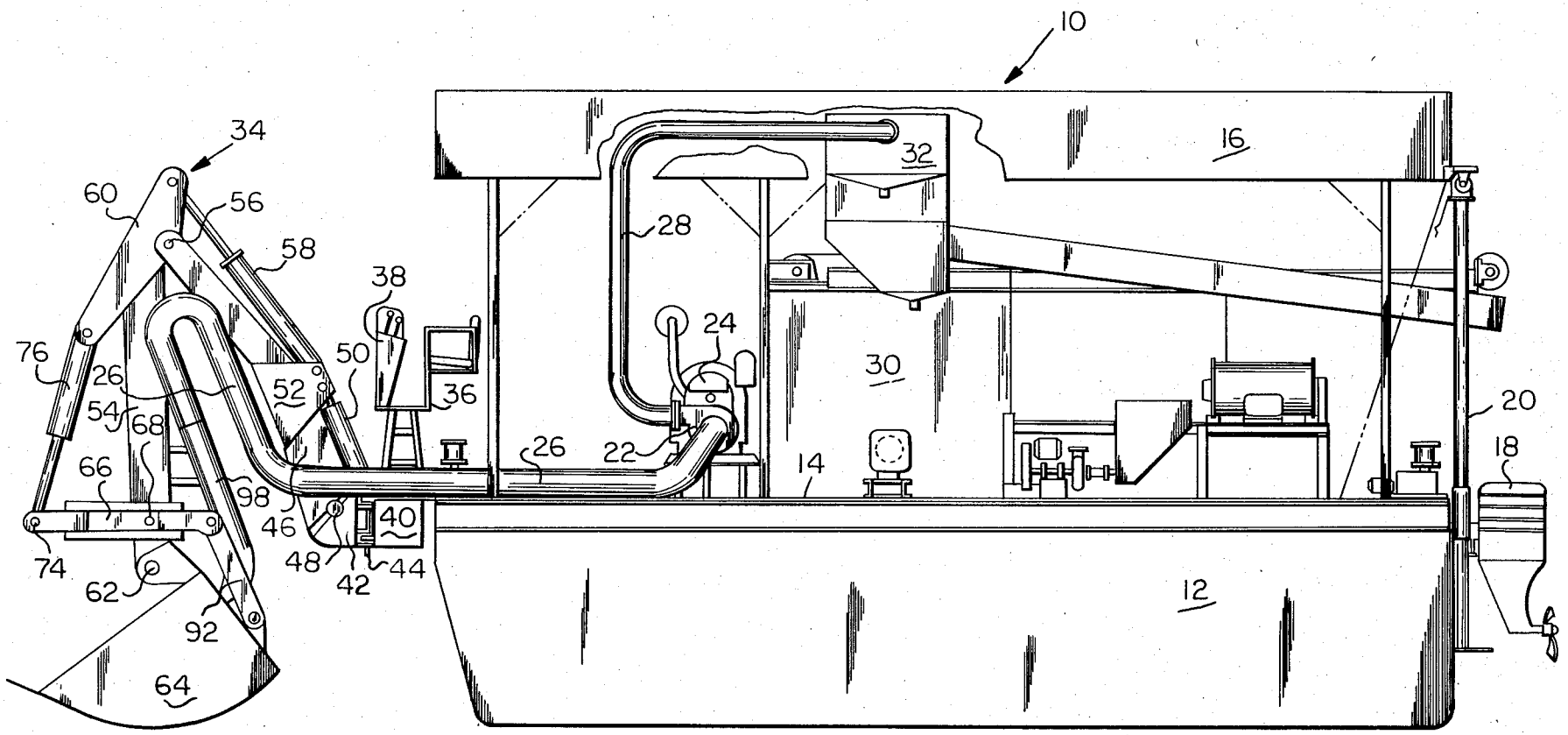
FIG. 1 is an elevational view of a barge utilizing the inventive concepts of the invention.

With reference to FIG. 1, a barge 10 is illustrated which includes a hull 12 and a deck 14 covered by a roof 16. A pair of outboard mtors 18 affixed to the barge stern provide mobility, and for stability a plurality of vertically positionable spuds or jacks 20 may be mounted upon the barge for raising and lowering by a cable system wherein engagement of the spuds with the waterway bottom will stabilize the barge during dredging. At the barge bow hydraulically operated stabilizer arms, not shown, may be mounted which are of sufficient length to engage the waterway bottom. Such stabilizers are similar to those used on backhoes and trucks, but may be of greater length.

A powerful pump 22 is mounted upon the deck 14 driven by the engine 24. The pump 22 includes a suction conduit 26, and the pressurized outlet conduit 28 receives the pump discharge. In the disclosed exbodiment, processing apparatus, generally indicated at 30, is mounted upon the barge deck for processing the dredged material to separate valuable minerals, such as gold. The apparatus 30 includes a hopper 32 communicating with the pump outlet conduit 28 for receiving the pumped dredged material. The particular nature of the processing apparatus forms no part of the present invention, and will vary according to the type of processing desired, and the barge 10 will contain no processing apparatus if the dredged material is to be pumped to a remote shore location, or cargo barge.

The dredge shovel apparatus 34 is mounted upon the barge bow and includes an operator control platform 36 upon which valve controls 38 are mounted to permit the operator to accurately manipulate the shovel during dredging. The shovel apparatus includes a frame 40 affixed to the barge to which the support 42 is mounted by the vertical pivot pin 44.

The shovel apparatus includes an arm 46 pivotally affixed to support 42 at 48, and the angular relationship between these components is adjusted by the expansible chamber hydraulic motor 50 connected to bracket 52 fixed to arm 46. The arm 54 is pivotally attached to arm 46 at 56, and the relative angular relationship between arm 46 and arm 54 is adjusted by the hydraulic expansible chamber motor 58 interposed between bracket 52 and the extension 60 of arm 54. Thus, in the known manner, the angular relationships of the arm 46 and 54 may be adjusted by the motors 50 and 58, and hydraulic motors, not shown, will pivot the shovel assembly 34 about the vertical pivot 44 in a horizontal direction. The aforedescribed shovel assembly is similar to that found on many "backhoe" shovels.

Figure 4:
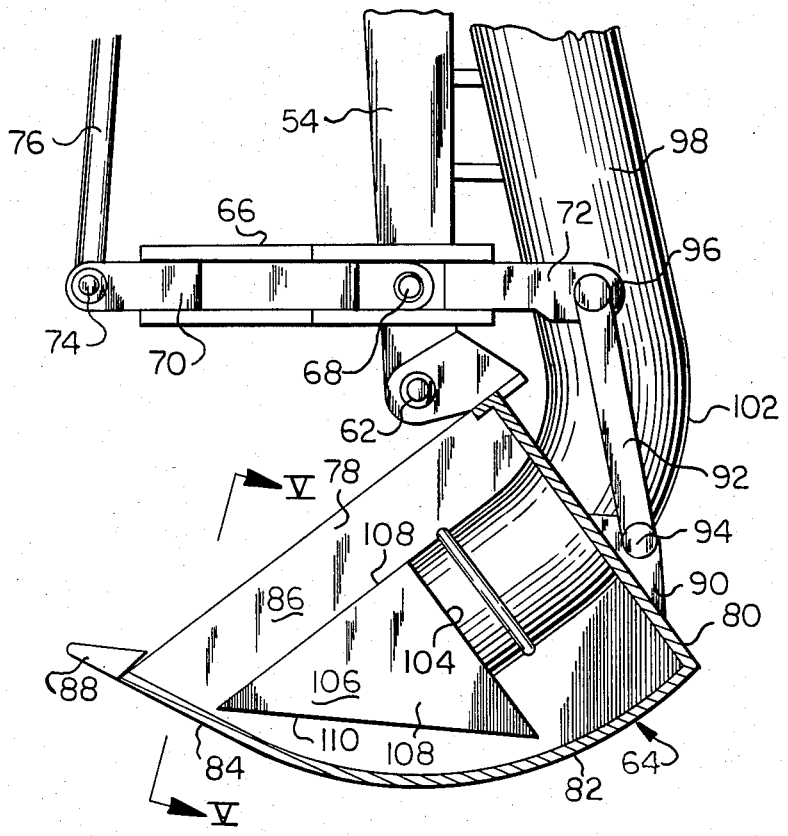
FIG. 4 is a side, elevational, sectional view of the bucket and associated shovel apparatus as taken along Section IV—IV of FIG. 3.
Figure 5:
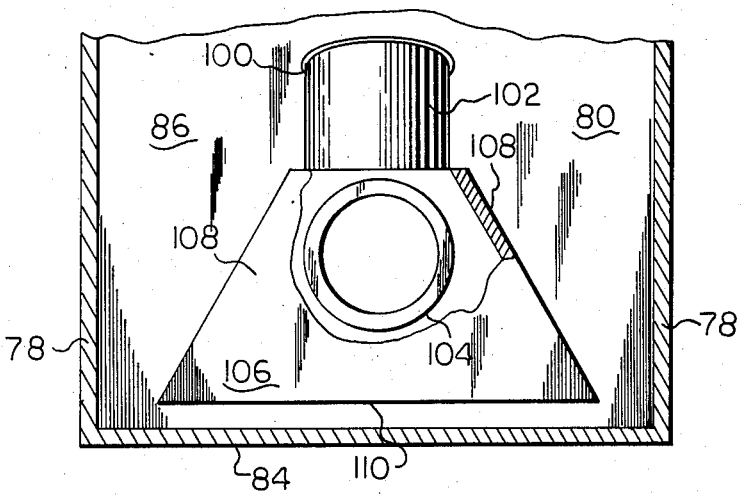
FIG. 5 is an elevational, sectional view as taken along Section V—V of FIG. 4.

At its outer end the arm 54 is provided with a pivot pin 62 upon which the shovel bucket 64 is pivotally mounted, FIG. 4. Pivoting of the bucket 64 is achieved by the yoke 66 pivotally attached to the arm 54 at 68 by links 70 which form a part of the yoke. The yoke 66 includes extensions 72 which extend over the rear portion of the bucket 64 and the links 70 extend forwardly of the arm 54 terminating at pivot 74. The pivot 74 is connected to the piston of the hydraulic expansible chamber motor 76 mounted upon arm extension 60 and extension and retraction of the piston will oscillate the yoke 66 about its pivot axis 68.

The configuration of the shovel bucket 64 will be appreciated from FIGS. 2-5 and the bucket includes parallel spaced side walls 78, a rear wall 80, a bottom wall 82, and a front wall 84. These walls define a receptacle 86 for receiving the dredged material, and the front edge of the front wall is preferably provided with teeth 88 in the known manner to facilitate digging and breaking up of the material being dredged.

Figure 3:
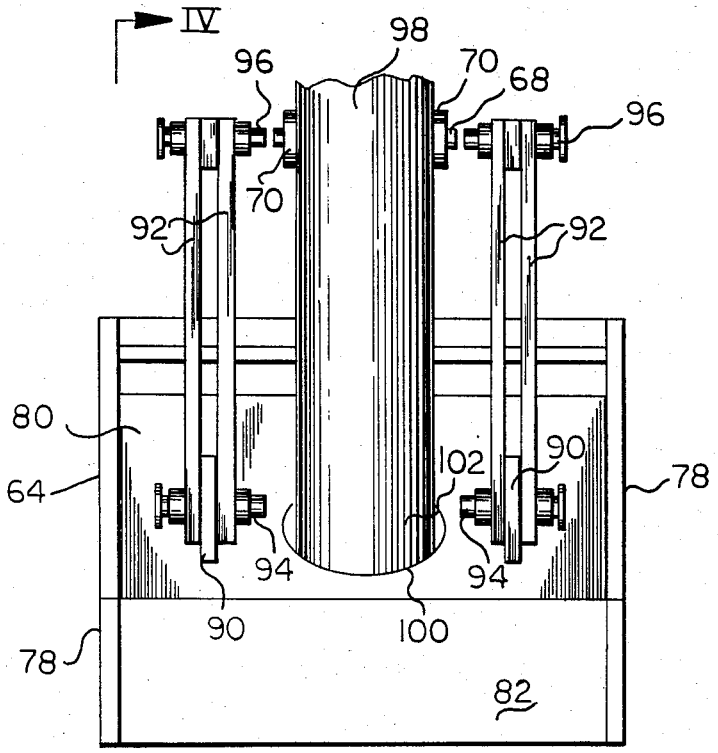
FIG. 3 is a rear, elevational view of the bucket and associated components.

The rear wall 80 is provided with a pair of weldments 90 whereby linkages 92 connect the weldments to the yoke extensions 72 by pivot pins 94 and 96, FIG. 3. Thus, it will be appreciated that as the piston of motor 76 is extended and retracted, pivoting of the yoke 66 will produce a pivoting of the bucket 64 about the pivot pin 62.

A rigid evacuation conduit 98 is affixed to the back side of the arm 54, and at its upper end the evacuation conduit is attached to the end of the flexible pump suction conduit 26, FIG. 1.

The bucket rear wall 80 is provided with a central opening 100, FIG. 3, and the lower end of the evacuation conduit 98 extends therethrough. As shown in FIG. 4, the lower end of the conduit 98 includes an elbow 102 terminating in the inlet end 104 to which is affixed the bell 106 consisting of a plurality of diverging walls 108 terminating in a lower open end defined by peripheral edges 110.

The elbow 102 of conduit 98 extending through opening 100 constitutes a circular configuration whose center is defined as the bucket pivot 62. Thus, as the bucket 64 pivots about pivot 62, no interference will occur between the conduit 98 and the bucket rear wall 80 and the bucket may be adjusted as desired without interference from the conduit.

Further, the bucket bottom wall 82 constitutes a segment of a cylinder whose center is at the pivot 62, and accordingly, as the bucket 64 pivots, the dimensional clearance between the bottom wall 82 and the bell peripheral edge 110 will be constant. As this clearance determines the maximum size of particles which may enter the conduits 98 and 26 and pump 22, this concentric relationship between the bottom wall 82 and pivot 62 will insure consistent protection of the pump. As will be noted from FIG. 5, the width of the bell 106 is only slightly less than the separation between the bucket side walls 78, and the material within the bucket will be drawn into the bell throughout its periphery preventing accumulation and buildup of dredge material within bucket receptacle 86.

Figure 2:
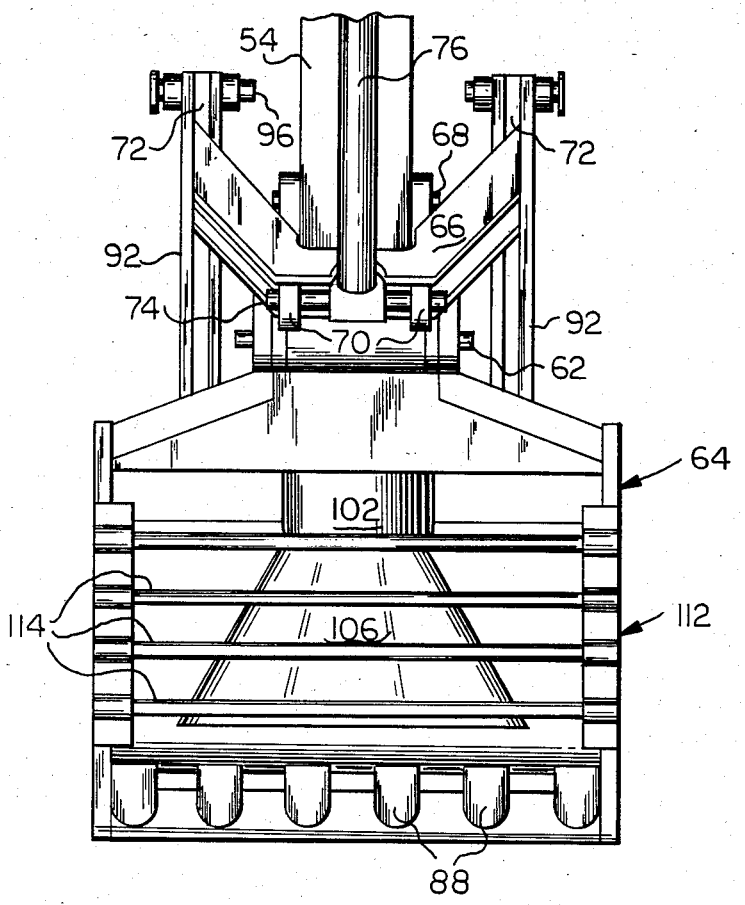
FIG. 2 is a detail, enlarged, front elevational view of the shovel bucket apparatus.

To further prevent oversize particles from entering the bucket receptacle, a grill 112 may be placed over the bucket open top consisting of a plurality of parallel bars 114, FIG. 2. For purpose of clarity of illustration, the grill bars are omitted from FIG. 4.

In use, the barge 10 will be located as desired, and the jacks 20 lowered to provide maximum stability. As described above, other types of hydraulic jacks or stabilizers may be mounted on the barge as is known in the stabilizing arts. The pump motor 24 is started, and the dredging operation is under the control of the operator seated at the control platform 36.

The shovel apparatus motors 50, 58 and 76 will be energized as desired to manipulate the position and operation of the bucket 64. The bucket will be maintained underwater at all times during dredging and relatively short forward movements of the bucket will fill the bucket with the material being dredged. As the pump 22 will be rapidly ingesting water and dredged material under the bell peripheral edge 110 and into the evacuation conduit 98 the material being received within the bucket is rapidly being removed therefrom and pumped through conduit 28 into the processing apparatus 30. The "dredging" movements of the bucket are most efficiently achieved as the usual hoisting, swinging and dumping motions of power shovels are completely eliminated.

The bucket 64 is capable of dredging highly compacted and heavy consolidated material, and very heavy materials dug, such as gold, will be received within the bucket and drawn into the suction conduit 26 in view of the high velocity of slurry movement under the bell periphery 110. Thus, recovery of heavy metals is possible with this apparatus which could not be achieved with more conventional cutterheads used with suction systems. Further, the apparatus of the invention can work among rocks and stumps which would quickly damage other types of suction dredging heads.

An underwater TV camera, not shown, may be mounted upon the lower end of the arm 54, if desired, to permit observation of the underwater work.

It is appreciated that various modifications to the inventive concepts may be apparent to those skilled in the art, for instance, the configuration of the inlet of the evacuation conduit may take a number of forms, without departing from the spirit and scope of the invention.

I claim:

1. A shovel dredge system comprising, in combination, a barge, a motor-driven pump mounted upon said barge having an outlet conduit and a suction conduit, power-driven shovel apparatus mounted upon said barge, said shovel apparatus including a bucket, a shovel bucket pivot mounted upon said shovel apparatus having an axis, said bucket being pivotally mounted upon said pivot, said bucket comprising a rear wall, a front wall, a bottom portion and side walls defining a receptacle having an open top, an opening defined in said rear wall, control means mounted on said barge controlling movement of said shovel apparatus and pivotal movement of said bucket upon said pivot, an evacuation conduit mounted on said shovel apparatus and fixed with respect to said bucket and extending into said bucket receptacle through said rear wall opening and having an inlet within said bucket, said shovel bucket bottom portion being of an arcuate configuration having a radius whose center is located at said shovel bucket pivot, said evacuation conduit inlet comprising a bell having a lower peripheral edge disposed adjacent said shovel bucket bottom portion, the spacing between said bell peripheral edge and said bucket bottom portion being substantially constant during pivoting of said bucket, said pump suction conduit being connected to said evacuation conduit whereby said pump suction conduit supplies said pump from said shovel bucket.

2. In a hydraulic shovel dredge system as in claim 1, said evacuation conduit being rigid and including an arcuate portion located within said opening defined in said shovel bucket rear wall portion, said arcuate portion having a radius whose center is located at said shovel bucket pivot.

3. In a hydraulic shovel dredge system as in claim 2, said bell having a width slightly less than the spacing between said shovel bucket side portions.

4. A shovel dredge system comprising, in combination, a barge, a motor-driven pump mounted upon said barge having an outlet conduit and a suction conduit, power-driven shovel apparatus mounted upon said barge, said shovel apparatus including a plurality of pivotally interconnected elongated arms having an inner end mounted upon said barge and a free outer end, hydraulic expansible chamber motors operatively connected to said arms controlling the relative position thereof, control means mounted on said barge controlling said expansible chamber motors, a shovel bucket pivot mounted on said shovel apparatus outer end having an axis, a shovel bucket pivotally mounted upon said pivot, said bucket comprising a rear wall portion, a front wall portion, a bottom portion and side portions defining a receptacle having an open top, said front wall portion terminating in an edge adapted to engage and pick up the material being dredged and received within said bucket, an opening defined in said shovel bucket rear wall portion, an evacuation conduit mounted on said shovel apparatus and fixed with respect to said bucket having an inlet within said shovel bucket receptacle, said evacuation conduit extending into said bucket receptacle through said opening, said shovel bucket bottom portion being of an arcuate configuration having a radius whose center is located at said shovel bucket pivot, said evacuation conduit inlet comprising a bell having a lower peripheral edge disposed adjacent said shovel bucket bottom portion, the spacing between said bell peripheral edge and said bucket bottom portion being substantially constant during pivoting of said bucket, said pump suction conduit being connected to said evacuation conduit whereby said pump suction conduit supplies said pump from said shovel bucket.

5. In a hydraulic shovel dredge system as in claim 4, said evacuation conduit being rigid and including an arcuate portion located within said opening defined in said shovel bucket rear wall portion, said arcuate portion having a radius whose center is located at said shovel bucket pivot.

6. In a hydraulic shovel dredge system as in claim 5, said bell having a width slightly less than the spacing between said shovel bucket side portions.

* * * * *